United States Patent [19]

Dusch

[11] Patent Number: 4,669,401

[45] Date of Patent: Jun. 2, 1987

[54] LOCKSTITCH SEWING MACHINE WITH A ROTARY HOOK

[75] Inventor: Albert Dusch, Kaiserslautern, Fed. Rep. of Germany

[73] Assignee: Pfaff Industriemaschinen GmbH, Fed. Rep. of Germany

[21] Appl. No.: 811,648

[22] Filed: Dec. 20, 1985

[30] Foreign Application Priority Data

Dec. 20, 1984 [DE] Fed. Rep. of Germany ..... 3446548

[51] Int. Cl.[4] ..... D05B 57/08; D05B 57/26

[52] U.S. Cl. ..... 112/231

[58] Field of Search ..... 112/181, 182, 183, 184, 112/228, 231

[56] References Cited

U.S. PATENT DOCUMENTS 1,351,869 9/1920 Petti ..... 112/231
1,809,391 6/1931 Parkes ..... 112/184
2,866,425 12/1958 Palmbach ..... 112/184 X

FOREIGN PATENT DOCUMENTS 566188 12/1932 Fed. Rep. of Germany .
3303033 8/1984 Fed. Rep. of Germany ..... 112/184

*Primary Examiner*—Wm. Carter Reynolds
*Attorney, Agent, or Firm*—McGlew and Tuttle

[57] ABSTRACT

A lockstitch sewing machine includes a rotary hook, with a bobbin housing and a cam is provided for the rotation-secure retention of the bobbin housing and it is arranged a small distance behind the stitch hole in the direction of hook rotation. A holding finger for holding the bobbin housing against rotation with the hook body projects from the bobbin housing, as well as a supporting finger arranged substantially 90° before the stitch hole. A shoulder projecting from the bobbin housing is associated with the supporting finger.

2 Claims, 5 Drawing Figures

LOCKSTITCH SEWING MACHINE WITH A ROTARY HOOK

FIELD AND BACKGROUND OF THE INVENTION

This invention relates, in general, to sewing machines and in particular to a new and useful lockstitch sewing machine having a rotary hook.

In the sewing machine known from German Pat. No. 566,188, the rotary hook comprises a bobbin housing including a bobbin capsule carrier part and a bobbin capsule part. A laterally projecting holding finger is formed at the bobbin capsule carrier part which protrudes between two cams arranged at fixed locations in the vicinity of the stitch hole of the stitch plate. At the beginning of the guiding of the needle thread loop around the bobbin housing, the needle thread must be moved through between the holding finger and what, in the direction of hook rotation, is the ear cam, and at the end of the looping, between the holding finger and the front cam. To avoid that, with the rotary hook revolving: the holding finger, which applies against the rear cam due to the friction, will hinder the looping of the needle thread loop, the hook is operated with a capsule release device. At the beginning of looping, this device imparts to the bobbin housing a rotational impulse opposite to the direction of hook rotation, whereby a thread passage gap is formed briefly between the holding finger and the rear cam. Thereafter, the bobbin housing is again taken along in the direction of hook rotation, whereby now a thread passage gap is formed between the holding finger and the front cam. Although the gap is wide enough, after the guiding of the needle thread loop around the bobbin housing, a brief impediment of the thread movement occurs nevertheless during the upward pull-back. This is because of the lower edge, turned toward the holding finger, of the front cam projects into the pull-off path of the needle thread loop and briefly retains the upwardly moved needle thread loop, which toward the end of the pull-back spins in part uncontrolled, until it snaps off the cam laterally into the thread passage gap. Due to this retention effect of the front cam, coming into play in particular at high rotational speed, the needle thread tension must be increased in an undesirable manner.

By German Pat. No. OS 33 03 033 it is proposed to connect the holding finger which serves to prevent rotation of the bobbin housing firmly with the base plate outside the area of the stitch hole and to let its free end engage radially to the hook axis into a U-shaped cutout in the bobbin capsule. Preferably the holding finger is to be arranged diametrically to the stitch hole. By moving the holding means which serve to prevent rotation of the bobbin housing into a region diametrically opposite the stitch hole, it is now indeed possible to pull the needle thread loop upward unhindered after completed looping around the bobbin housing, but then an impediment of the thread movement occurs during the guiding of the needle thread loop around the bobbin housing, in that it must squeeze through between the holding finger and the abutment surfaces of the cut-out at the time of its greatest expansion.

In the case of a shuttle known from German Pat. No. 521 407, (U.S. Pat. No. 1,803,391). which has been taken into consideration in the present invention, there is formed on the sidewall of a cup shaped bobbin housing an upwardly projecting holding finger which applies against a cam directed downwardly from the stitch plate. The cam is located in the direction of hook rotation a greater distance before the stitch hole of the stitch plate and prevents, when the sewing machine is running, a co-rotation of the bobbin housing. At substantially equal distance from the stitch hole, but lying on the other side thereof, there is arranged at the stitch plate a supporting finger which serves as protection against reverse rotation, and whose free end protruded into a cutout in the bobbin carrier and cooperates with a first abutment surface formed by the latter. Further, a capsule release device is provided, the finger of which cooperates with a second abutment surface formed by an upwardly extending shoulder.

Although in this rotary hook, the cam extending downward from the stitch plate is arranged a relatively great distance before the stitch hole and between it and the holding finger a sufficiently wide thread passage gap exists during passage of the thread, yet the cam again forms an obstacle which impairs the looping or pull-back movement of the needle thread loop and which requires an increased needle thread tension.

SUMMARY OF THE INVENTION

This invention provides a rotary hook where the holding means which prevent co-rotation and reverse rotation of the bobbin housing are arranged so that they hinder the looping of the needle thread loop, and in particular the pull-back movement of the needle thread loop occurring after its maximum expansion, as little as possible.

Due to the measure of arranging the cam, similarly as in the rotary hook of German Pat. No. 566,188, a small distance behind the stitch hole, the deflection which inevitably occurs when the needle thread is moved through the gap created by the capsule release device between holding finger and cam, an the impediment of thread movemen caused thereby, takes place at the beginning of the looping of the needle thread loop. But at that time a brief impediment of the thread movement has no quality diminishing influence on the stitch formation, because the jumping of the needle thread which occurs after the deflection point has been passed is intercepted during the progressing expansion of the needle thread loop.

During the pull-back movement which occurs subsequent to the maximum expansion of the needle thread loop, the needle thread loop slides almost without a jerk over the lateral faces of the shoulder, which are substantially tangential to the outer surface of the bobbin housing, so that the shoulder has practically no negative influence on the thread movement and the subsequent stitch insertion in the work. Since during the pull-back of the needle thread loop the bobbin capsule applies by its holding finger against the cam and hence there is a thread passage gap between the support finger and the shoulder, and since moroever the needle thread loop still slides along closely at the front, ascending lateral face of the shoulder during the first part of its pull-back movement, the needle thread never comes in contact with the support finger, so that it can have no influence at all on the thread movement.

The rotary hook according to the invention thus distinguishes itself by a motion of the needle thread loop which has especially little jerkiness and friction, and this in particular during the phase crucial for satisfactory stitch formation, namely during the pullback of the needle thread loop. In this way, not only is an always satisfactory stitch insertion of the threads into the work achieved, but also the needle thread tension and hence the danger of thread rupture can be reduced.

Accordingly, it is an object of the invention to provide an improved sewing machine rotary hook construction which includes an improved arrangement for handling the needle thread loop.

A further object of the invention is to provide a sewing machine having an improved rotary hook construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
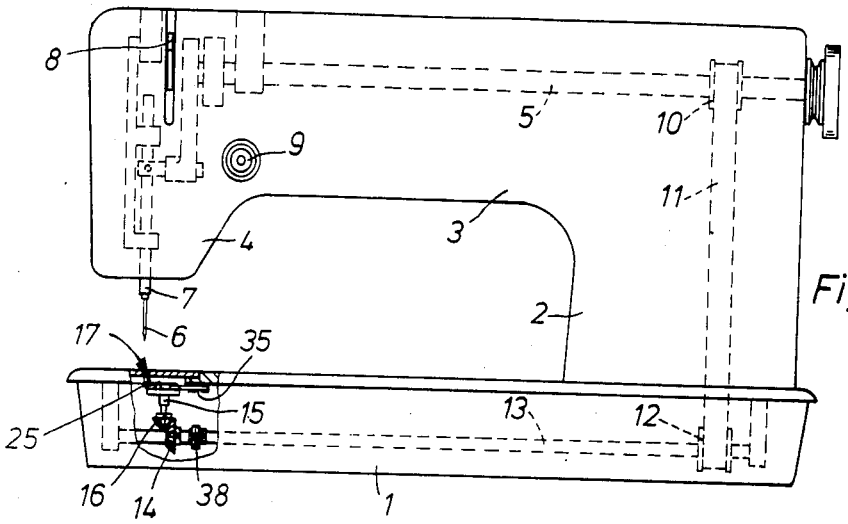
FIG. 1 is a side elevational view of a sewing machine constructed in accordance with the invention.
Figure 2:
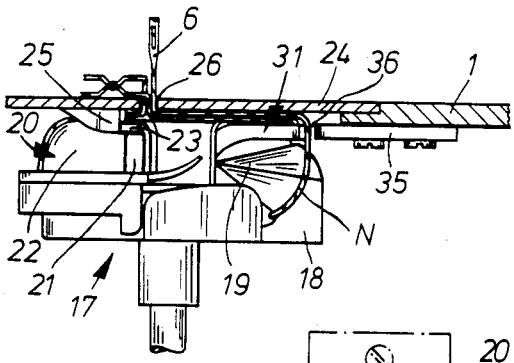
FIG. 2 is a side elevational view of the sewing machine rotary hook, the capsule release device being omitted in the interest of greater clarity.
Figure 3:
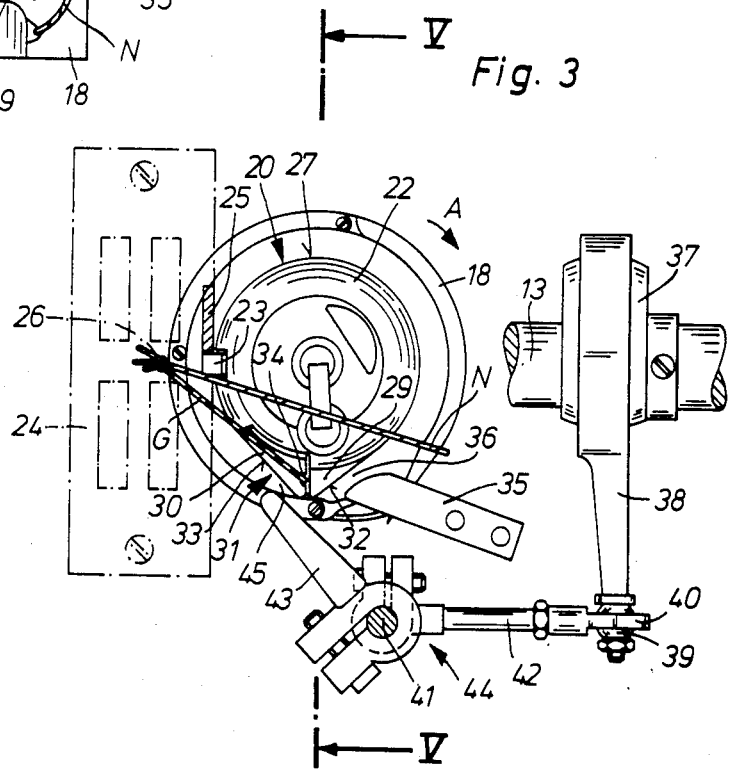
FIG. 3 is an end elevational view onto the rotary hook and the capsule release device.
Figure 4:
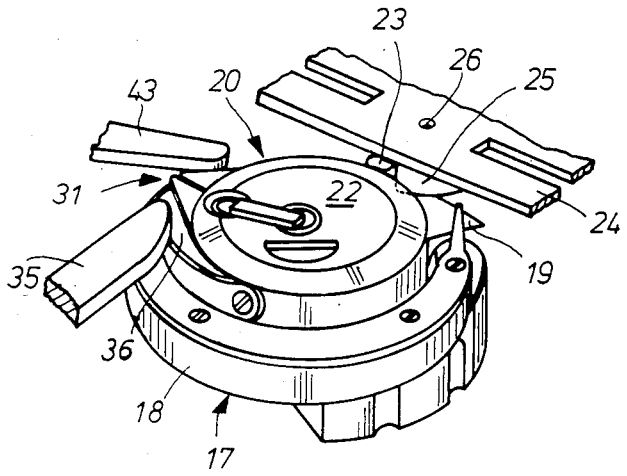
FIG. 4 is a top perspective view of the rotary hook.
Figure 5:
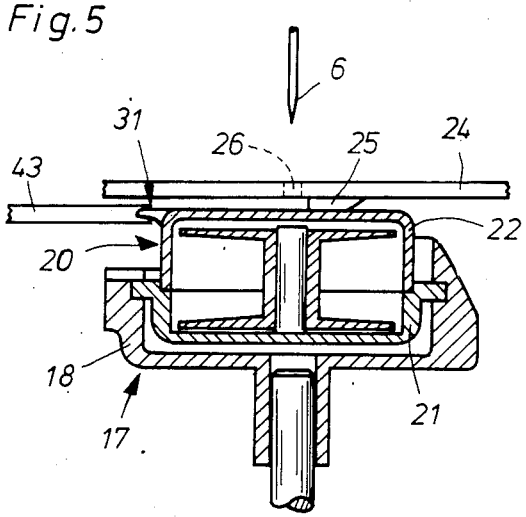
FIG. 5 is a side sectional view of the rotary hook taken on an opposite side from that shown in the elevational view of FIG. 2.

Referring to the drawings, in particular, the invention embodied therein comprises a lockstitch sewing machine which has a stitch plate 24 with a rotary hook therebelow of improved construction. The rotary hook includes a revolving hook body 18 on which is supported a rotatable bobbin housing having a housing 20 whose periphery is designated 27 and which has a shoulder 31 that extends to the side and is formed by two appendages 29 and 30. A cam 25 is supported on stitch plate adjacent the bobbin housing and a holding finger 23 is adjacent the cam 25. The holding finger 23 and the cam 25 secure the housing against co-rotation with the hook body 18. A fixed supporting finger 35 cooperates with the bobbin housing 20 and it has a first abutment surface adjacent the bobbin housing. Bobbin housing 20 comprises a bobbin capsule 22 and a capsule carrier 21 which carries the capsule. Bobbin housing 20 is rotatably suported on hook body 18.

The construction includes a bobbin capsule release generally designated 44 which includes a capsule release finger 43 with a second abutment surface adjacent the bobbin housing 20. The stitch plate has a stitch hole 26 for the penetration of the threaded needle 6. The cam 25 is adjacent to but behind in the direction of the hook rotation A, the stitch hole 26. The bobbin housing 20 has faces to be described later, against which the abutment surfaces defined by the supporting finger and the capsule release finger, are engageable. The shoulder 31 is arranged at substantially 90° before the stitch hole.

The sewing machine includes a base plate 1, a standard 2, and an arm 3 with a head 4. In the arm 3 is mounted an arm shaft 5, which is in drive connection with a needle bar 7 movable up and down in head 4 and carrying a threaded needle 6. Also mounted in the head 4 is a thread take-up lever 8 which, in a known manner, cooperates with the needle 6 and executes an up and down movement, and which is also driven by the arm shaft 5. In head 4, a thread tensioning device 9 is arranged.

Secured on the arm shaft 5 is a belt pulley 10 which via a belt 11 and a belt pulley 12 transmits the drive movement of the arm shaft 5 to the hook drive shaft 13 mounted in the base plate 1, in the speed ratio 1:1. Secured on the hook drive shaft is a bevel gear 14 which meshes with a counter-gear 16 disposed on the vertical hook shaft 15 and thus drives in the ratio 1:2 the lockstitch rotary hook 17 disposed at the upper end of the hook shaft 15 and revolving in a horizontal plane.

The lockstitch rotary hook 17 has the hook body 18 and a hook tip 19 formed thereon. In the hook body 18 the bobbin housing 20 is supported, which comprises the bobbin capsule 22. The laterally projecting holding finger 23 is formed on a bobbin capsule carrier 21. Associated with the holding finger 23 is the cam 25 secured on the underside of the stitch plate 24 recessed in the base plate 1, which cam is arranged a small distance behind the stitch hole 26 in the direction of hook rotation A.

At the bobbin capsule 22 and at the bobbin capsule carrier 21, in the same plane, the two projections 29 and 30 project laterally from the outer surface or periphery 27 of the bobbin housing 20 and are separated from each other by only a narrow gap and together they form the triangular shoulder 31. The outer side of projection 29 forms what, in the direction of hook rotation A, is the front side face 32 of shoulder 31. The outer side of projection 30 forms what, in the direction of hook rotations A, is the rear side face 33 of shoulder 31. Both faces 32 and 33 are substantially tangential to the outer surface 27 of the bobbin housing 20.

The flat supporting finger 35 is attached on the base plate 1, the rounded free end of which is opposite the front side face 32 of shoulder 31. With the sewing machine running, the bobbin housing 20 is suported by the holding finger 23 on cam 25, and this hinders the rotation of a bobbin housing 20 along with the hook ody 18. In this case, a relatively large gap 36 exists between the front end of the supporting finger 35 and the front side face 32 of shoulder 31. Finger 35 functions to prevent reverse rotation of the bobbin housing by engaging against front side face 32.

On the hook drive shaft 13 an eccentric 37 is secured, which has a spherical circumferential surface. The eccentric 37 is spanned by one end of an eccentric rod 38, the other end of which carries a spherically shaped head 39. The head 39 is spanned by a socket 40 which is arranged on a crank 42 secured on a vertically mounted shaft 41. Clamped on shaft 41 is the horizontally extending finger 43, whose free end is opposite the rear side face 33 of shoulder 31, the long side of finger 43 toward shoulder 31 being substantially parallel to the rear side face 33. Parts 37 to 43 form the capsule release device 44.

Depending on the position of the eccentric 37, either a gap 45 exists between the finger 43 and the rear side face 33 or the finger 43 abuts against the rear side face 33 and in so doing rotates the bobbin housing 20 counter to the direction of hook rotation A.

After the start of stitch formation the hook tip 19 has seized the needle thread loop N formed by the needle 6, the finger 43 driven by eccentric 37 moves against the rear side face 33 and imparts to the bobbin housing 20 a rotational impulse directed counter to the direction of hook rotation A, owing to which the holding finger 23 moves away from cam 25. In this manner, the needle thread loop N can be moved by the hook body 18 through the gap between the holding finger 23 and cam 25. The resulting deflection of the needle thread loop N and the inhibition of the thread movement caused thereby occurs at a time when loop N is being expanded still further and thus the thread slack previously created by the thread take-up liner is used up. At this time of looping a brief impediment of the thread movement has no adverse influence on the stitch formation, because irregular thread movements are compensated during the further expansion of the needle thread loop.

The needle thread loop N having been moved beyond the point of maximum expansion, the thread take-up lever 8 begins to pull the needle thread loop N back. At that time the eccentric 37 has moved the finger 43 away from shoulder 31, and the bobbin housing 20 has co-rotated with the hook body 18 in the direction of hook rotation A, owing to which the holding finger 23 abuts on cam 25 again. During the pullback movement of the needle thread loop N the latter drops off the hook tip 19, moves unhindered through the gap 36 between the supporting finger 35 and the front side face 32, and then slides over the tip to shoulder 31 almost without a jerk. Thereafter the needle thread loop N is moved by the thread feeder 8 through the gap 45 between the finger 43 and the rear side face 33 and is finally pulled back completely through the stitch hole together with a section of the hook thread G.

Since during its pull-back movement brought about by the thread take-up lever 8 the needle thread loop N experiences no impediment except for the slight deflection around the shoulder 31, the rotary hook 17 is outstanding for an especially jerk-free and low-friction motion of the needle thread loop N.

While a specific embodiment of the invention has been shown and described in detail to illustrate the application of the principles of the invention, it will be understood that such invention may be embodied otherwise without departing from such principles.

What is claimed is:

1. In a lockstitch sewing mchine having a stitch plate with a rotary hook therebelow, the improvement comprising a revolving hook body, a bobbin housing rotatably supported in said hook body and having a housing shoulder defining first and second abutment surfaces, a cam supported on said stitch plate adjacent said bobbin housing, a holding finger on said bobbin housing adjacent said cam, said holding finger and said cam being engageable for securing said housing against co-rotation with said hook body, a fixed supporting finger cooperating with said bobbin housing first abutment surface and disposed adjacent said bobbin housing, said bobbin housing comprising a bobbin capsule, a bobbin capsule release having a capsule release finger member cooperating with said second abutment surface adjacent said bobbin housing, said stitch plate having a stitch hole for the penetration of a threaded needle, said cam being adjacent to the stitch hole, said bobbin housing having a lateral face, said first and second abutment surfaces being substantially tangential to the lateral face of said bobbin housing, said shoulder being disposed about 90° in front of the stitch hole in the rotation direction of said hook body.

2. In a lockstitch sewing machine according to claim 1, wherein said bobbin capsule release includes a release shaft disposed at spaced locations to the periphery of said hook body, said capsule release finger being secured to said shaft for rotation thereby, a drive connected to said shaft to rotate said shaft, said finger defining a lateral gap between it and said support finger and between it and said shoulder which is adjustable with movement of said finger.

* * * * *